US007585152B2

(12) United States Patent
Chambers et al.

(10) Patent No.: US 7,585,152 B2
(45) Date of Patent: Sep. 8, 2009

(54) COOLING JETS

(75) Inventors: Andrew Chambers, Oxford (GB); Geoffrey Dailey, Derby (GB); David Gillespie, Oxford (GB); Peter Ireland, Oxford (GB)

(73) Assignee: Rolls-Royce plc, London (GB)

( * ) Notice: Subject to any disclaimer, the term of this patent is extended or adjusted under 35 U.S.C. 154(b) by 821 days.

(21) Appl. No.: 10/946,105

(22) Filed: Sep. 22, 2004

(65) Prior Publication Data

US 2005/0074325 A1 Apr. 7, 2005

(30) Foreign Application Priority Data

Oct. 3, 2003 (GB) ..... 0323228.7

(51) Int. Cl.
*B63H 1/14* (2006.01)
*F01D 5/14* (2006.01)

(52) U.S. Cl. ..... 416/97 A; 415/115; 415/116

(58) Field of Classification Search ..... 416/96 R, 416/96 A, 97 R, 97 A; 415/115, 116
See application file for complete search history.

(56) References Cited

U.S. PATENT DOCUMENTS 4,884,304 A * 12/1989 Elkins ..... 5/421
5,779,437 A * 7/1998 Abdel-Messeh et al. .... 415/115
6,547,524 B2 * 4/2003 Kohli et al. ..... 416/97 R

FOREIGN PATENT DOCUMENTS

EP 0416542 A 3/1991
JP 6248901 A 9/1994

* cited by examiner

*Primary Examiner*—Hoang M Nguyen
(74) *Attorney, Agent, or Firm*—Jeffrey S. Melcher; Manelli Denison & Selter PLLC

(57) ABSTRACT

Cooling jets 1 are provided with a longitudinal aspect 2 greater than width 3. Thus, the coolant flow through the jet 1 is less susceptible to deflection by lateral or cross flows presented to that coolant flow such that cooling by impingement of the coolant flow upon a surface 7 to be cooled is improved. Typically, a plurality of jets 1 are provided in a housing wall 8. These jets 1 will be arranged in an appropriate pattern to achieve cooling by flow impingement upon the surface 7 to be cooled. Possibly, a plurality of jets 1 in an appropriate pattern may be arranged upstream of conventional circular coolant jets in order to provide some protection for those circular coolant jets from lateral or cross flow.

11 Claims, 1 Drawing Sheet

COOLING JETS

FIELD OF THE INVENTION

The present invention relates to cooling jets and more particularly to cooling jets used in turbine engines whereby a flow of coolant typically in the form of air is projected towards a surface in order to cool that surface.

BACKGROUND OF THE INVENTION

There are a number of situations where it is necessary to provide cooling in order to achieve operational efficiency and structural integrity. One situation where cooling is required is within a turbine engine.

A gas turbine engine generally comprises, in axial flow series, an air intake, a propulsive fan an intermediate pressure compressor, a high pressure compressor, a combustor, a turbine arrangement comprising a high pressure turbine, an intermediate pressure turbine and a low pressure turbine, and an exhaust nozzle. The gas turbine engine operates in a conventional manner so that air entering the intake is accelerated by the fan which produces two air flows: a first air flow into the intermediate pressure compressor and a second air flow which provides propulsive thrust. The intermediate pressure compressor compresses the air flow directed into it before delivering that air to the high pressure compressor where further compression takes place. The compressed air exhausted from the high pressure compressor is directed into the combustor where it is mixed with fuel and the mixture combusted. The resultant hot combustion products then expand through, and thereby drive, the high, intermediate and low pressure turbines before being exhausted through the nozzle to provide additional propulsive thrust. The high, intermediate and low pressure turbines respectively drive the high and intermediate pressure compressors and the fan by suitable interconnected shafts.

In such circumstances it will be appreciated that there are high temperature gas flows which impinge upon vanes and blades within an engine. Generally, the higher an engine can operate in terms of temperature the higher that engine's efficiency. Unfortunately, there are inherent limitations upon acceptable operational temperatures of the materials from which engine components such as vanes and blades are made. In such circumstances air cooling is provided in order to ensure these components remain within acceptable operational ranges.

Generally cooling jets project a flow of air taken from the compressor towards parts which require cooling. Typically these cooling jets are circular to maximise cross-section for coolant jet impingement upon the surface to be cooled. It will be understood that generally the design or specification of coolant jets is considered in a static situation whereby the coolant jet is considered as a simple column projected beyond the coolant jet with little consideration as to leakage or deflection from impingement.

Unfortunately, within a turbine engine it will be appreciated that there is generally a significant lateral draft due to impingement wash of other jets and rotation of the relative turbine engine components. This lateral draft may be perpendicular to the projection direction of the coolant air flow from the coolant jet that is to say across it. In such circumstances, there is deflection of the collimated coolant jet and there is a significant deviation from the theoretically possible degree of cooling provided by a unit coolant air flow. Clearly, the more coolant air which impinges or strikes upon the surface to be cooled the greater the cooling efficiency. In some cases, there may be so great a deflection of the coolant air flow that there is no impingement.

SUMMARY OF THE INVENTION

In accordance with the present invention there is provided a coolant jet for a turbine engine, the jet defined by a passage in a wall from which in use a coolant flow is projected towards a surface to be cooled by that coolant flow, the passage having a cross-section with a longitudinal aspect greater than its width to provide improved resistance to lateral draught deflection in that longitudinal aspect.

Preferably, the jet has an aspect ratio between the longitudinal aspect and the width in the range up to 4 times greater and most preferably in the range 1.2 to 1.5.

Typically, the passage is substantially perpendicular to an exit surface of the wall. Alternatively, the passage is angled relative to an exit surface of the wall. Furthermore, where angled the passage is angled towards a source direction of the principal lateral draught.

Preferably, the passage has a race-track cross-section, that is to say curved ends with a straight section between them. Possibly, the passage is elliptical or oval in cross-section. Alternatively, the passage has an asymmetrical cross-section for best resistance to lateral draught dispersion in the longitudinal aspect.

Typically, the passage has a length significantly greater than the width of the jet. Generally, the length of the passage is dependent upon the distance between the jet and the surface, the dimensions of the cross-section and the coolant flow rate.

Possibly, the passage has shoulder portions either side of the passage extending in the general direction of a principal lateral draught.

Possibly, the passage cross-section varies with temperature to alter the ratio between the longitudinal aspect and the width.

Also in accordance with the present invention there is provided a turbine engine housing wall incorporating a plurality of coolant jets as described above.

Typically, the housing will also include a plurality of circular coolant jets downstream of the coolant jets as described above.

Further in accordance with the present invention there is provided a turbine engine incorporating a turbine engine housing wall or a coolant jet as described above.

BRIEF DESCRIPTION OF THE DRAWINGS

Embodiments of the present invention will now be described with reference to the attached drawings in which.

DETAILED DESCRIPTION OF THE INVENTION

Figure 1:
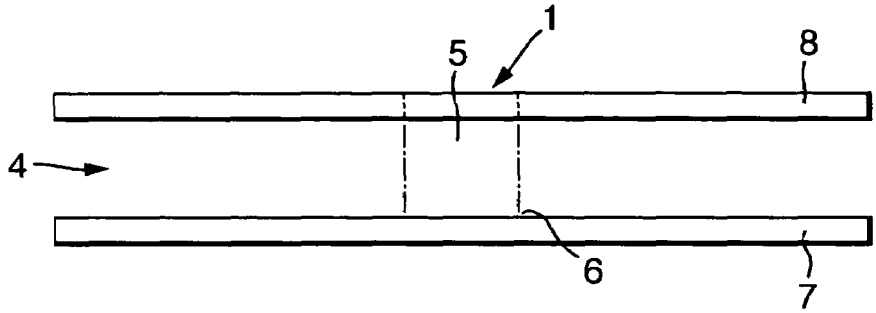
FIG. 1 is a schematic cross-section of a coolant jet in association with a surface to be cooled in accordance with the present invention.
Figure 2:
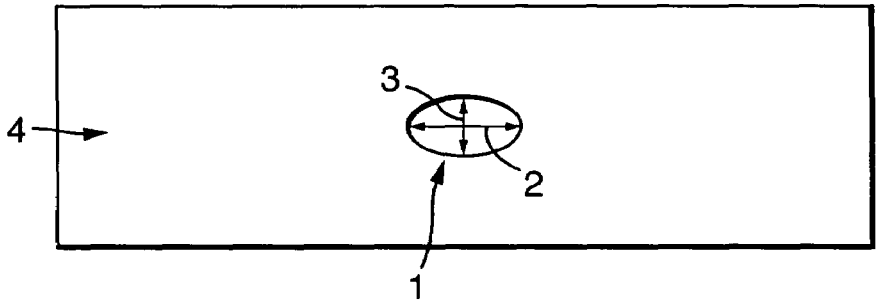
FIG. 2 is a schematic plan view of the coolant jet depicted in FIG. 1; and, FIG. 3 is a graphic illustration of a turbine engine showing possible location of coolant jets in accordance with the present invention.

The present invention addresses problems associated with lateral or cross flow draughts presented to a coolant flow projected from a coolant jet to impinge upon a wall surface in order to cool that surface. Coolant jets in accordance with the present invention have a cross-section whereby the longitudinal aspect or axis is greater than the width of the coolant jet. Typically, as illustrated in FIGS. 1 and 2 a coolant jet in accordance with the present invention has race track cross-section through a passage in a housing wall. However, other shaped cross-sections are possible dependent upon expected lateral draughts presented to the coolant jet. These alternatives include asymmetric cross-sections as well as lozenge and triangle shapes.

The end result of using jets that are able to better traverse the cross flow will be an increased heat transfer on the target surface to be cooled. Impingement of coolant flow in cross flows at typical velocity ratio and aspect ratio of this coolant jet passage will provide enhancement to the background heat transfer level and so cooling. Enhancement is provided by two principal mechanisms. Firstly the jet disrupts the boundary layer and sheds turbulence created by its mixing with the surrounding flow rising the heat transfer. Secondly in long passages the temperature of the cross flow will rise and increased heat transfer will be achieved through having the newly introduced colder flow striking the surface. If a coolant flow has better penetration properties both the aforementioned effects will probably result in increased heat transfer rates.

The invention consists of using elliptical or otherwise shaped holes to improve heat transfer in impingement systems with cross flow. Jet impingement is often used as a means of improving heat transfer. In large arrays of jets significant cross flow can build up from other impingement flow wash and this causes a change in the flow structures and a decrease in the heat transfer enhancement offered by the impinging flow. In most previous systems circular jets are used, but these are not optimal for situations where cross flow is present. The present invention provides a streamlined or shaped jet that is able to provide heat transfer enhancement over a circular jet in the presence of crossflow. A coolant jet flow emerging from a suitably shaped orifice is able to better traverse a cross flow and thus provide maximum heat transfer on the target surface to be cooled.

FIG. 1 and FIG. 2 schematically illustrate a coolant jet 1 in accordance with the present invention. The jet 1 has an elliptical cross-section with a longitudinal aspect 2 greater than a width 3. In use, the aspect 2 is arranged in alignment with the direction 4 of the expected principal lateral or cross draught. A coolant air flow 5 is presented through the jet 1 such that that flow impinges upon a target area 6 of a wall surface 7 to be cooled.

As indicated above ideally the target area 6 should be substantially the same as the jet 1 cross-section or more predictable for efficient cooling of the surface 7. However, with previous coolant jets which are of a circular cross-section such a situation was prevented by the lateral draught 4 deflecting the coolant flow 5. Such dispersal of the flow 5 limits the volume of coolant air impinging on the surface 7 and in severe situations may result in no coolant air impingement. It will also be understood that the deflection of the coolant air flow will greatly increase the size of the impingement area upon the surface 7 beyond the predicted target area 6 further undermining expected cooling efficiency.

By providing a greater longitudinal aspect 2 the present invention provides resistance to dispersal such that there is a closer approximation to an impingement target area 6 which is the same as or predicted for the coolant jet 1. Clearly, the distance between a housing wall 8 incorporating the jet 1 and the surface 7 significantly affects the degree of deflection along with the rate of coolant flow 5 but the present invention provides proportionately greater resistance to such deflection compared to previous circular cross-section coolant jets.

As indicated above generally the jet 1 has an elliptical or oval cross-section. The aspect ratio between the longitudinal aspect 2 and the width 3 will be up to four times greater but is usually in the range 1.2 to 1.5. The longitudinal aspect 2 is determined as required by expected operational conditions.

As shown in the FIGS. 1 and 2 the jet 1 is formed as a passage through the housing wall 8 which is substantially perpendicular to the surface from which the coolant flow 5 is projected. Alternatively, the passage may be angled relative to the surface of the housing wall 8. Generally, this angle will be towards the source of the lateral draught, that is to say upstream, to project the coolant flow 5.

The passage which defines the coolant jet 1 has a length which is determined by the thickness of the housing wall 8. Clearly, the longer the passage then the greater will be the entrainment of the coolant flow 5. In such circumstances, the passage may be extended by collets which are secured about the jet 1 on one side or both sides so as to provide an effectively longer passage.

By providing an elliptical cross-section for coolant jet 1 it is possible that problems with structural weakness and stresses in comparison with previous circular cross-section coolant jets are diminished.

By appropriate selection of materials and construction it is possible where required or necessary that the cross-section may vary with local temperature of the housing wall 8 and/or the coolant air flow. Such variation may be advantageous where alterations in cooling efficiency may be utilised. An example of such a situation may be during warm-up where lower efficiency circular jets are first present and then these jets develop an elliptical cross-section as temperature increases.

In order to further improve projection of the coolant flow 5 it may be advantageous to build up shoulder portions either side of the coolant jet 1.

In addition to an oval or elliptical cross-section a coolant jet with a dumb-bell shape or other symmetrical cross-section both along the line of the direction of the principal lateral draught presented to the flow 5, that is to say the longitudinal aspect as well as the width could be provided. These cross-sections could also include a kite or lozenge or triangle shape.

Figure 3:
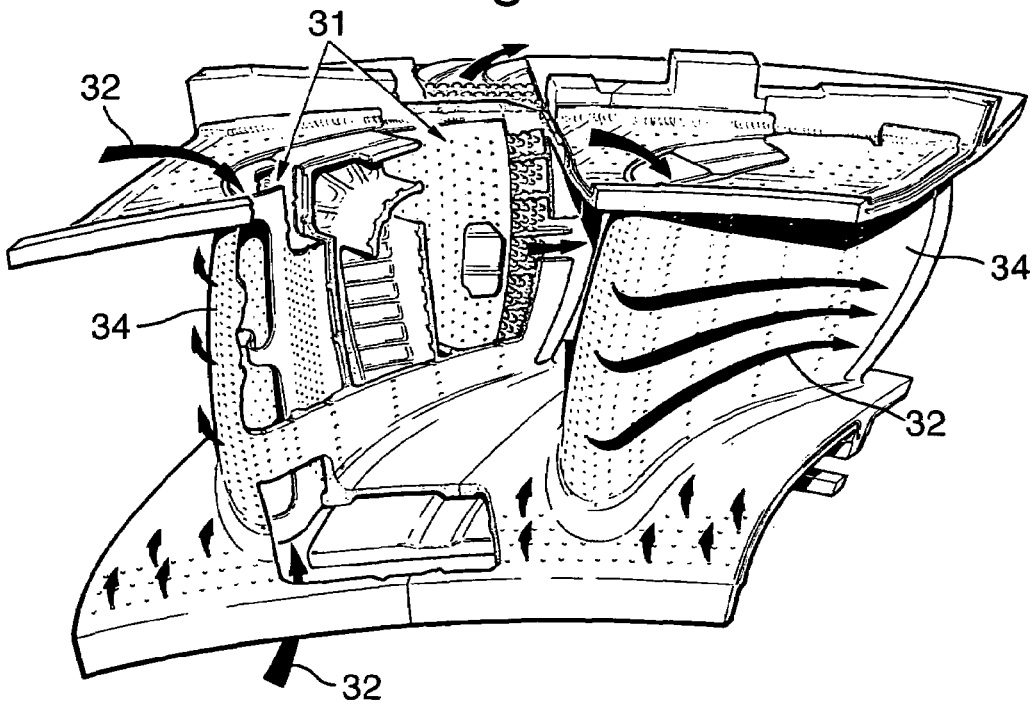

As indicated above generally a number of coolant jets will be arranged in a pattern within a wall surface in order to present coolant flows which impinge upon a surface to be cooled. FIG. 3 illustrates a situation where coolant jets in accordance with the present invention are located within impingement plates or tubes 31 which in turn are located within guide vanes of a turbine engine. Thus, coolant air flows pass through the coolant jets to impinge upon the inner surface of the vanes in order to cool them. It will be understood that the specific distribution of the coolant jets in an appropriate pattern is determined by relative component shapes as well as desired cooling efficiency and necessity. However, the greater predictability of coolant jets in accordance with the present invention will allow more reliable design and possibly cooling capacity to be incorporated into vanes and blades in particular within turbine engines than previously. In particular, the present invention will be beneficial with relatively fine coolant jets.

Air flows are depicted by arrowheads 32 in FIG. 3 such that the flows 32 are presented within vanes 34 in order that these flows are presented through the plates or tubes 31 as housing walls of the turbine engine. The flow presented through the coolant jets in the plates or tubes 31 impinges upon an inner surface of vanes 34 which, in turn, may have apertures to allow surface film cooling of these vanes 34.

The coolant jet pattern provided will depend upon positioning, orientation and configuration of the vane and maybe regular as depicted or unevenly distributed in response to required or desired cooling efficiency by coolant flow impingement in accordance with the present invention.

By use of coolant jets in accordance with the present invention it will be understood that previously simply circular coolant jets are avoided. These previous circular coolant jets may introduce stresses and strains within the wall surface so that problems with such stresses and strains may be reduced.

Also in accordance with the present invention is provision of a coolant jet pattern which combines previous circular coolant jets and present coolant jets configured to have a longitudinal aspect significantly greater than its width. An arrangement of coolant jets in accordance with the present invention is provided upstream in terms of the expected principal lateral or cross flow in order to protect conventional previous circular coolant jets downstream from the disturbing effects of such lateral flow. The coolant jets in accordance with the present invention act as a screen or curtain of resistance to lateral flow dispersion by presenting a more substantial aspect to that flow through its shape. This cross flow may be relatively weak and so the resistance provided by the coolant jets of the present may restrain such cross or lateral flows thereby protecting the downstream conventional circular coolant jets.

Forming coolant jets in accordance with the present invention is more difficult than previous circular coolant jets if formed by drilling. However, normally present cooling jets are formed by casting. There may be advantageous in providing a mix of coolant jets in accordance with the present invention and 'protected' circular previous coolant jets conventionally formed whether by drilling or casting.

Alternatives and variations to the present invention are possible within the scope of the present invention. Thus, while remaining with a greater longitudinal aspect it will be understood where desirable the passage from which the jet is formed may have a dumb-bell or waisted cross-section. Furthermore the passage cross-section could vary through its depth or the passage exit located within a hollow or formed to extend from a raised plateau formed in the wall surface to enhance the coolant jet performance directed towards the surface to be cooled.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A turbine engine housing having a wall incorporating a plurality of cooling jets being arranged such that flow from said jets impinges upon a target area of a surface to be cooled, each cooling jet being defined by a passage and having a cross-section with a longitudinal aspect greater that its width, said longitudinal aspect being arranged in alignment with the direction of the expected principal cross-draught of coolant air flow between said housing wall and said surface to be cooled wherein the passage cross-section varies with temperature to alter the ratio between the longitudinal aspect and the width.

2. A turbine engine housing as claimed in claim 1 wherein the coolant jet has an aspect ratio between the longitudinal aspect and the width in a range up to 4 times greater.

3. A turbine engine housing as claimed in claim 2 wherein the aspect ratio is in the range 1.2 to 1.5.

4. A turbine engine housing as claimed in claim 1 wherein the passage is substantially perpendicular to an exit surface of the wall.

5. A turbine engine housing as claimed in claim 1 wherein the passage is angled relative to an exit surface of the wall.

6. A turbine engine housing as claimed in claim 5 wherein the passage is angled towards a source direction of the principal lateral draught.

7. A turbine engine housing as claimed in claim 5 wherein the angle is in the order of 60° to 80°.

8. A turbine engine housing as claimed in claim 1 wherein the passage has a length greater than the width of the jet.

9. A turbine engine housing as claimed in claim 1 wherein the length of the passage is dependent upon the distance between the jet and the surface to be cooled, the dimensions of the cross-section and the coolant flow rate.

10. A turbine engine housing as claimed in claim 1 wherein the housing also includes a plurality of circular coolant jets downstream of the plurality of coolant jets.

11. A turbine engine incorporating a turbine engine housing as claimed in claim 1.

* * * * *